US011246339B2

(12) United States Patent
Wright

(10) Patent No.: US 11,246,339 B2
(45) Date of Patent: Feb. 15, 2022

(54) CANTILEVERED OPERATING BUTTON FOR AN ELECTRONIC VAPOR PROVISION SYSTEM

(71) Applicant: NICOVENTURES HOLDINGS LIMITED, London (GB)

(72) Inventor: Jeremy Wright, London (GB)

(73) Assignee: NICOVENTURES HOLDINGS LIMITED, London (GB)

( * ) Notice: Subject to any disclaimer, the term of this patent is extended or adjusted under 35 U.S.C. 154(b) by 303 days.

(21) Appl. No.: 16/335,086

(22) PCT Filed: Sep. 21, 2017

(86) PCT No.: PCT/GB2017/052823

§ 371 (c)(1),
(2) Date: Mar. 20, 2019

(87) PCT Pub. No.: WO2018/055381

PCT Pub. Date: Mar. 29, 2018

(65) Prior Publication Data

US 2019/0208824 A1 Jul. 11, 2019

(30) Foreign Application Priority Data

Sep. 23, 2016 (GB) ..... 1616209

(51) Int. Cl.

| | |
|---|---|
| ***A24F 1/32*** | (2006.01) |
| ***A24F 40/60*** | (2020.01) |
| ***A24F 40/40*** | (2020.01) |
| ***H01H 21/02*** | (2006.01) |
| ***H01H 21/04*** | (2006.01) |
| *A24F 40/10* | (2020.01) |

(52) U.S. Cl.

CPC ..... *A24F 1/32* (2013.01); *A24F 40/40* (2020.01); *A24F 40/60* (2020.01); *H01H 21/025* (2013.01); *H01H 21/04* (2013.01); *A24F 40/10* (2020.01)

(58) Field of Classification Search

CPC . A24F 1/32; A24F 40/60; A24F 40/00; H01H 21/025

See application file for complete search history.

(56) References Cited

U.S. PATENT DOCUMENTS 5,130,897 A * 7/1992 Kuzma ..... H01H 13/023 362/23.01
5,396,911 A 3/1995 Casey
D485,639 S 1/2004 Stronski
(Continued)

FOREIGN PATENT DOCUMENTS

CN 203162984 8/2013
CN 302876551 7/2014
(Continued)

OTHER PUBLICATIONS

International Preliminary Report on Patentability, Application No. PCT/GB2017/052823, dated Apr. 4, 2019, 8 pages.
(Continued)

*Primary Examiner* — Vanessa Girardi
(74) *Attorney, Agent, or Firm* — Patterson Thuente Pedersen, P.A.

(57) ABSTRACT

An electronic vapor provision device including a cantilever and a button which is configured to be operated by the cantilever.

16 Claims, 5 Drawing Sheets

(56) References Cited

U.S. PATENT DOCUMENTS

| | | | | |
|---|---|---|---|---|
| D532,927 | S | 11/2006 | Sann | |
| D644,375 | S | 8/2011 | Zhou | |
| D676,621 | S | 2/2013 | Florkiewicz et al. | |
| D691,324 | S | 10/2013 | Saliman | |
| D696,455 | S | 12/2013 | Abroff | |
| D718,492 | S | 11/2014 | Albanese | |
| D720,499 | S | 12/2014 | Alima | |
| D720,882 | S | 1/2015 | Albanese | |
| D720,883 | S | 1/2015 | Albanese | |
| D723,216 | S | 2/2015 | Chen | |
| D725,310 | S | 3/2015 | Eksouzian | |
| D736,994 | S | 8/2015 | Mittersinker | |
| D743,622 | S | 11/2015 | Alima | |
| D748,853 | S | 2/2016 | Seibel | |
| D750,834 | S | 3/2016 | Wei | |
| D750,835 | S | 3/2016 | Wei | |
| D752,278 | S | 3/2016 | Verleur | |
| D753,874 | S | 4/2016 | Moreno | |
| D756,031 | S | 5/2016 | Wu | |
| D757,352 | S | 5/2016 | Bagai | |
| D760,948 | S | 7/2016 | Eksouzian | |
| D761,998 | S | 7/2016 | Pinder | |
| 9,399,110 | B2 * | 7/2016 | Goodman | A61M 15/0065 |
| D763,501 | S | 8/2016 | McGarry | |
| D764,701 | S | 8/2016 | Malhi | |
| D768,915 | S | 10/2016 | Wright et al. | |
| D773,727 | S | 12/2016 | Eksouzian | |
| D776,337 | S | 1/2017 | Levin | |
| D776,869 | S | 1/2017 | Heidl | |
| D779,719 | S | 2/2017 | Qiu | |
| D780,991 | S | 3/2017 | Liu | |
| D782,728 | S | 3/2017 | Pinder | |
| D786,497 | S | 5/2017 | Sudlow | |
| D787,114 | S | 5/2017 | Scott | |
| D790,123 | S | 6/2017 | Beer | |
| D790,124 | S | 6/2017 | Beer | |
| D792,021 | S | 7/2017 | Beer | |
| D792,643 | S | 7/2017 | Wong | |
| D795,496 | S | 8/2017 | Beer | |
| D799,110 | S | 10/2017 | Qiu | |
| D799,112 | S | 10/2017 | Qiu | |
| D799,113 | S | 10/2017 | Qiu | |
| D799,745 | S | 10/2017 | Qiu | |
| D800,383 | S | 10/2017 | Verleur et al. | |
| D802,839 | S | 11/2017 | Scott | |
| D804,091 | S | 11/2017 | Fornarelli | |
| D825,099 | S | 8/2018 | Wright | |
| D825,103 | S | 8/2018 | Wright | |
| 10,244,793 | B2 * | 4/2019 | Monsees | A24F 42/10 |
| 10,932,489 | B2 * | 3/2021 | Lewis | A24F 40/42 |
| 2010/0200008 | A1 | 8/2010 | Taieb | |
| 2012/0230659 | A1 | 9/2012 | Goodman | |
| 2012/0312742 | A1 * | 12/2012 | Sassow | C05F 9/00 210/603 |
| 2013/0042865 | A1 | 2/2013 | Ploom | |
| 2013/0152954 | A1 | 6/2013 | Youn | |
| 2013/0199528 | A1 | 8/2013 | Goodman | |
| 2013/0312742 | A1 | 11/2013 | Monsees | |
| 2014/0026903 | A1 | 1/2014 | Haider | |
| 2014/0182609 | A1 | 7/2014 | Qiuming | |
| 2014/0283858 | A1 | 9/2014 | Liu | |
| 2015/0034104 | A1 | 2/2015 | Zhou | |
| 2015/0059786 | A1 | 3/2015 | Li | |
| 2015/0101623 | A1 | 4/2015 | Liu | |
| 2015/0128971 | A1 | 5/2015 | Verleur et al. | |
| 2015/0181930 | A1 | 7/2015 | Liu | |
| 2015/0181940 | A1 | 7/2015 | Liu | |
| 2015/0208728 | A1 | 7/2015 | Lord | |
| 2015/0333542 | A1 | 11/2015 | Alarcon et al. | |
| 2015/0342255 | A1 | 12/2015 | Wu | |
| 2016/0050976 | A1 | 2/2016 | Righetti | |
| 2016/0113325 | A1 | 4/2016 | Liu | |
| 2016/0150823 | A1 | 6/2016 | Liu | |
| 2016/0020463 | A1 | 7/2016 | Alarcon et al. | |
| 2016/0213065 | A1 | 7/2016 | Wensley et al. | |
| 2016/0270441 | A1 | 9/2016 | Lewis et al. | |
| 2016/0270446 | A1 | 9/2016 | Shenkal et al. | |
| 2016/0278163 | A1 | 9/2016 | Chen | |
| 2016/0278436 | A1 | 9/2016 | Verleur et al. | |
| 2016/0286864 | A1 | 10/2016 | Lin | |

FOREIGN PATENT DOCUMENTS

| | | | |
|---|---|---|---|
| CN | 303115457 | S | 2/2015 |
| CN | 104432543 | | 3/2015 |
| DE | 19616917 | | 10/1997 |
| EM | 001279020-0001 | | 7/2011 |
| EM | 001307631-0024 | | 4/2012 |
| EM | 001316533-0003 | | 6/2012 |
| EP | 1170763 | | 1/2002 |
| GB | 2429584 | | 2/2007 |
| GB | 2519781 | | 5/2015 |
| IT | 1402478 | | 9/2013 |
| JP | 1519006 | S | 3/2015 |
| JP | 1519007 | S | 3/2015 |
| JP | 1561415 | S | 10/2016 |
| JP | 1563215 | S | 11/2016 |
| JP | 1563216 | S | 11/2016 |
| RU | 96946 | S | 1/2016 |
| WO | WO2008015441 | | 2/2008 |
| WO | WODM081209 | | 6/2013 |

OTHER PUBLICATIONS

Russian Decision to Grant, Application No. 2019107611, dated Oct. 25, 2019, 10 pages.

Great Britain Examination Report, Application No. GB 1616209.1, dated Feb. 5, 2020, 4 pages.

Great Britain Search Report, Application No. GB1616209.1, dated Feb. 16, 2018, 4 pages.

International Search Report and Written Opinion, Application No. PCT/GB2017/052823, dated Dec. 7, 2017, 11 pages.

Wikipedia, *Computer Mouse*, as available at https://en.wikipedia.org/w/index.php?title=Computer mouse&oldid=739430781, Mar. 5, 2019, 10 pages.

Russian Decision to Grant, Application No. 2017500458, dated Feb. 7, 2018, 4 pages.

Russian Decision to Grant, Application No. 2017500459, dated Feb. 7, 2018, 7 pages.

Japanese Application No. 2017-001853, Notice of Allowance dated Jun. 30, 2017, 3 pages.

Japanese Application No. 2017-001854, Notice of Allowance dated Jun. 30, 2017, 3 pages.

Japanese Office Action, Japanese Application No. 2014-018491, dated Jun. 2, 2015, 2 pages.

Office Action for Russian Design Application No. 2014503384, dated Jul. 22, 2015, 4 pages.

* cited by examiner

CANTILEVERED OPERATING BUTTON FOR AN ELECTRONIC VAPOR PROVISION SYSTEM

PRIORITY CLAIM

The present application is a National Phase entry of PCT Application No. PCT/GB2017/052823, filed Sep. 21, 2017, which claims priority from GB Patent Application No. 1616209.1, filed Sep. 23, 2016, which is hereby fully incorporated herein by reference.

FIELD

The present disclosure relates to an electronic vapor provision system, e.g. an e-cigarette.

BACKGROUND

Electronic vapor provision systems such as e-cigarettes generally contain a reservoir of liquid which is to be vaporized (referred to herein as e-liquid). These systems are usually further provided with a heater, for example a wire coil, and some form of transport mechanism (e.g. a wick) to convey the liquid from the reservoir to the heater. Such systems generally also contain a control unit and a battery, whereby the control unit operates the battery to provide power to a heater to vaporize a small amount of the liquid, which vapor is then inhaled by the user. Most e-cigarettes are powered by re-chargeable lithium ion batteries (or cells), which are to be found in a very widespread range of devices, not just e-cigarettes. Often the reservoir and heater are located in one unit (referred to as a cartridge or cartomizer), while the battery and control unit are located in a separate, detachable unit (sometimes referred to as the control unit or device portion).

An e-cigarette therefore generally incorporates two consumables, firstly the liquid to be vaporized, and secondly power in the battery. Regarding the former, once the reservoir of liquid has been exhausted, at least a portion of the device containing the reservoir, e.g. the cartridge, may be discarded to allow replacement with a new cartridge (although some systems permit re-filling of the cartridge). Regarding the latter, an e-cigarette usually provides some form of electrical connector to receive power from an external charging supply, thereby allowing the battery within the e-cigarette to be re-charged. Accordingly, the device portion is sometimes referred to as the re-usable component, while the cartridge is referred to as the disposable component.

E-cigarettes can typically be categorized as either button-operated or puff-activated, according to how the control unit determines when to activate (provide power to) the heater. In the former, a user presses (or touches) a button on the external surface of the e-cigarette, which cause the control unit to activate the heater. In the latter, an airflow or pressure sensor is used to detect when a user inhales on the e-cigarette, and this detection then triggers activation of the heater (but such a device may still have a button, e.g. for selecting an operating mode of the device).

One of the challenges for e-cigarettes is to provide a suitable control interface. This control interface typically has bi-directional operation. In a first direction of operation, the control interface is utilized by a user to provide instructions or commands to the e-cigarette, for example, to activate the e-cigarette, to change power settings, etc. In a second direction of operation, the control interface is utilized by the e-cigarette itself to provide information to the user, for example, to indicate if the battery is short of charge, etc. For an e-cigarette, and given the frequency and nature of use, it is desirable to provide a control interface that is robust, reliable, intuitive and straightforward for a user to operate.

SUMMARY

The disclosure is defined in the appended claims.

An electronic vapor provision device comprises a cantilever and a button which is configured to be operated by the cantilever. The cantilever may be configured to have a rest position, and may be resiliently deflected by a force from the rest position to operate the button. The cantilever may be further configured to return to the rest position when the force is removed.

BRIEF DESCRIPTION OF THE DRAWINGS

Various embodiments of the disclosure will now be described in detail by way of example only with reference to the following drawings.

DETAILED DESCRIPTION

As described above, the present disclosure relates to an electronic vapor provision system, such as an e-cigarette. Throughout the following description the term "e-cigarette" is used; however, this term may be used interchangeably with electronic vapor provision system, electronic aerosol delivery system, and other similar expressions.

Figure 1:
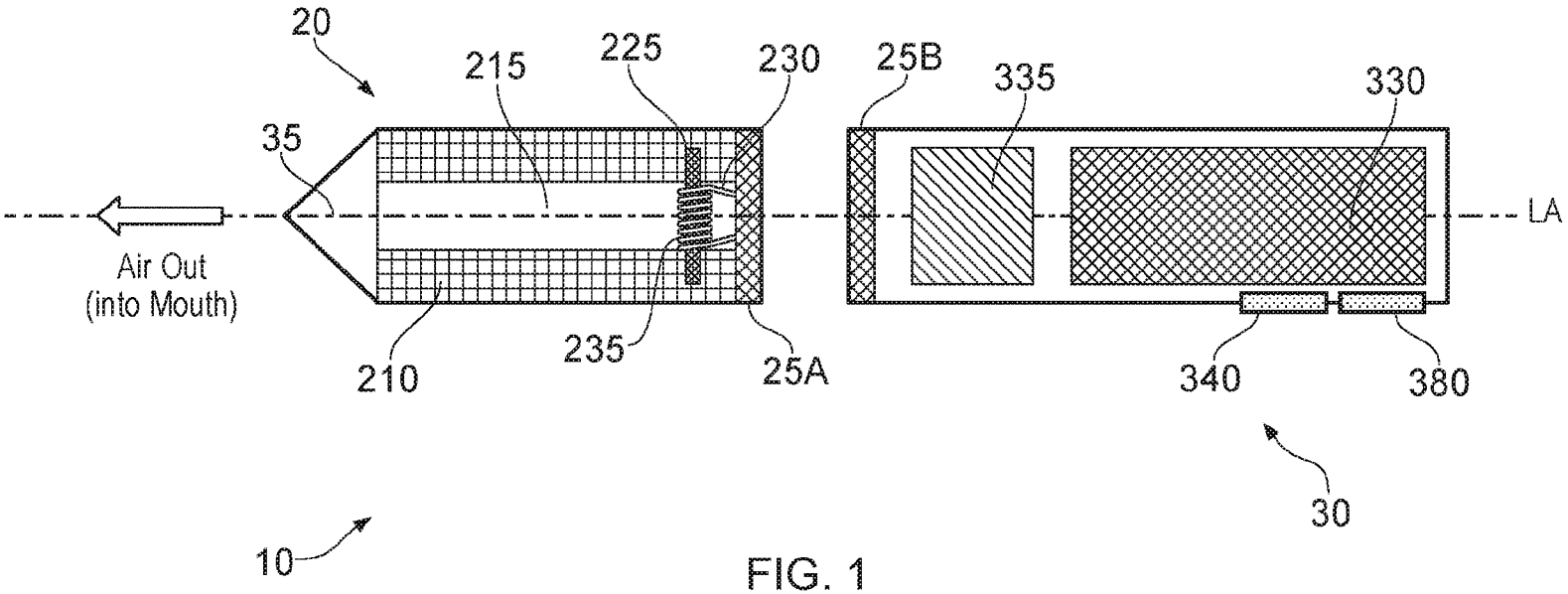
FIG. 1 is a schematic diagram of an e-cigarette in accordance with some embodiments of the disclosure.

FIG. 1 is a schematic diagram of an e-cigarette 10 in accordance with some embodiments of the disclosure (not to scale). The e-cigarette has a generally cylindrical shape, extending along a longitudinal axis indicated by dashed line LA, and comprises two main components, namely a cartomizer 20 and a device or body portion 30. The cartomizer is detachable from the body 30, as shown in FIG. 1, for example, to allow the cartomizer to be replaced (or refilled) if the e-liquid has been exhausted. In use, the cartomizer 20 and the body 30 are joined together. In particular, each of the cartomizer 20 and the body 30 is provided with a respective connector 25A, 25B (referred to herein in combination as connector 25) that provide mechanical and electrical connectivity between the cartomizer 20 and the body 30 when they are attached to one another. For example, connector 25 may provide a screw, bayonet, or push fit between the cartomizer 20 and the body 30.

The body portion includes a battery or cell unit 330, an operating button 340, a user interface 380, a printed circuit board (PCB) 335 containing various electronics, and connector 25B (please note that the electrical wiring between these different components is omitted for clarity). The battery unit 330 is typically re-chargeable and may support re-charging via a wired connection to one or more of connector 25B, to a tip connector (not shown) located on the end of the body 30 opposite to connector 25B, and/or to a separate connector, e.g. a micro-USB connector (not shown) accessible via the exterior of body 30. The battery may also support wireless re-charging via induction. (In practice, most e-cigarettes only provide a subset of one or two or these re-recharging facilities). Although only a single PCB 335 is shown in FIG. 1, it will be appreciated that this may be implemented as multiple PCBs. In addition, connector 25B and/or battery unit 330 may potentially also include a PCB.

Button 340 is operated to provide control input to the e-cigarette 10 for inhalation, for example, to activate the e-cigarette 10, thereby causing it to supply power from the battery 330 via connector 25 to the cartomizer 20 to vaporize e-liquid for inhalation by the user. Alternatively, the e-cigarette 10 of FIG. 1 is puff-sensitive. In this case, when a user inhales through the mouthpiece 35, air is drawn into the e-cigarette (typically the body 30) through the one or more air inlet holes, which are suitably located on the outside of the e-cigarette 10. This airflow (or the resulting change in pressure) is detected by a pressure or airflow sensor that in turn activates the heater to vaporize the liquid from the reservoir (via the wick). Some devices also utilize a dual activation mechanism, i.e. they are pressure-sensitive, but also require a button or similar facility to be operated in order to activate the heater.

The user interface 380 may provide for audio and/or visual output to provide status information to a user—e.g. a light which is green when the battery is fully charged, but orange when the battery is nearly discharged. Different audio and/or visual signals for signaling different states or conditions may be provided by utilizing tones or beeps of different pitch and/or duration, by providing multiple such beeps or tones, by utilizing colored or flashing lights, and so on. The button 340 and the user interface 380 can be considered as providing, in combination, a control interface for the e-cigarette 10.

The cartomizer 20 includes an internal chamber containing a reservoir 210 of e-liquid. The liquid in the reservoir may include nicotine in an appropriate solvent, and may include further constituents, for example, to aid aerosol formation, and/or for additional flavoring. This liquid may be held inside the chamber in some form of material, e.g. sponge, foam, or wadding, or may be provided as free liquid. Running through the centre of the reservoir is an air passage 215, which leads to a mouthpiece 35. In operation, e-liquid from reservoir 210 is vaporized (as described in more detail below), and the vapor then flows along air tube 215 and out through mouthpiece 35 to be inhaled by the user. Note that for clarity, the air inlet and air exit holes are not shown in FIG. 1. The air inlet holes may be provided on the exterior of the cartomizer 20, for example, close to (or as part of) connector 25A. The air inlet holes may alternatively (or additionally) be provided on an external surface of the body 30, in which case the connector 25 will generally include an air path that links to air path 215. Note that although FIG. 1 shows the air path 215 as flowing through the centre of reservoir 210 (which therefore has a tubular or annular shape), in other implementations, the air path 215 may be provided to one side of the reservoir 210, e.g. away from the main axis LA, and adjacent an outer wall of the cartomizer 20.

The cartomizer 20 is further provided with a wick 225 which transports e-liquid from the reservoir 210 to a heater or vaporizer 235 for vaporization. The wick may be formed of a suitable material, e.g. a fibrous material, such as (organic) cotton, glass fiber, etc, or some other form of porous material, e.g. a porous ceramic, a sintered substance, and so on. The cartomizer may be provided with appropriate sealing (not shown) around the location(s) where the wick 225 passes from the reservoir 210 into the air path 215 to prevent leakage of e-liquid from the reservoir 210 directly into the air path 215 (rather than the e-liquid being transported to the heater via wick 225).

The heater 235 is shown in FIG. 1 as a single coil which is wrapped around the wick 225. The heater 235 is electrically linked to the connector 25A by wires 230. When button 340 is pressed (or otherwise operated), the control unit 335 provides power from the battery 330 via connector 25 and wires 230 to the heater 235, which vaporizes liquid from wick 225. This vapor is then drawn along the air path and out through mouthpiece 35 into the mouth of a user by the user inhaling (puffing) on the e-cigarette. In addition, wick 225 draws out further e-liquid from the reservoir 210 to replace the e-liquid which has been vaporized, and hence the e-cigarette is then ready for further use.

Figure 2:
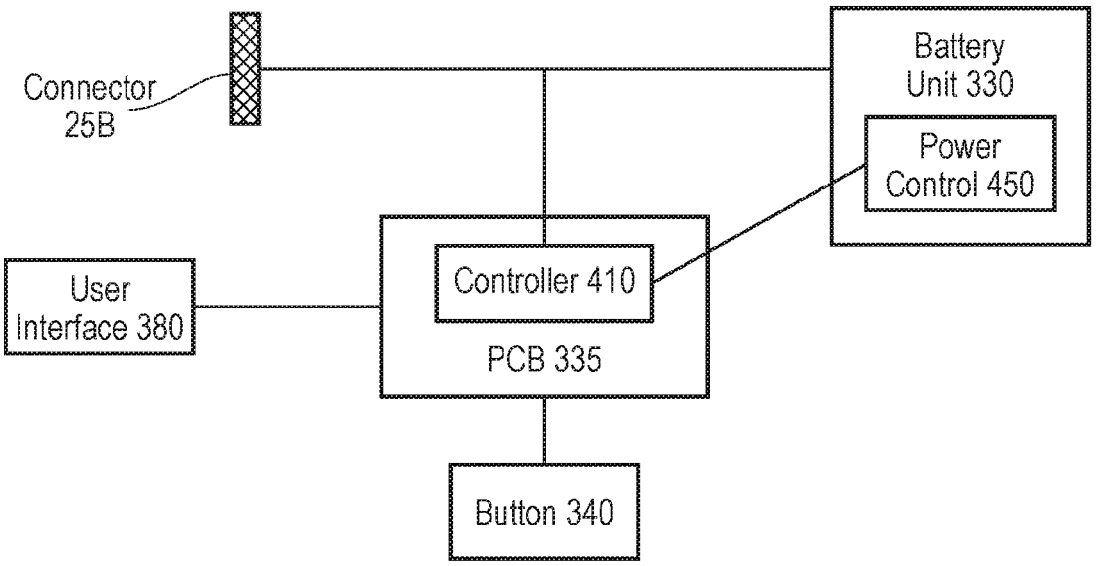
FIG. 2 is a schematic circuit diagram of some of the electrical and electronic components of the e-cigarette of FIG. 1 in accordance with some embodiments of the disclosure.

FIG. 2 is a schematic (simplified) diagram of the main electrical (electronic) components of the e-cigarette 10 of FIG. 1 in accordance with some embodiments. These components are generally located in the device portion (body) 30, since this is re-usable (rather than disposable). Note that this diagram is mainly concerned with functional connections, rather than supply power lines to the various components within the body 30 (although the power supply line from the battery unit 330 to the connector 25B is shown).

As discussed above, the device portion 30 includes a battery unit 330 for powering the e-cigarette 10, as well as a printed circuit board (PCB) 335 on which is mounted a controller 410. The PCB 335 may be positioned alongside or at one end of the battery 330. In the configuration shown in FIG. 1, the PCB 335 is located between the battery 330 and the connector 25B. The controller 410 may comprise, for example, an application specific integrated circuit (ASIC), microprocessor or microcontroller, for controlling the e-cigarette 10. In some implementations, the controller 410 includes a processor such as a CPU, and memory (ROM and/or RAM). The operations of the controller 410 (and hence also other electronic components in the e-cigarette 10), are generally controlled at least in part by software programs running on the processor (and/or on the other electronic components as appropriate). Such software programs may be stored in non-volatile memory, which can be integrated into the controller 410 itself, or provided as a separate component (not shown). The processor may access the ROM to load and execute individual software programs as and when required.

The body further includes connector 25B, which provides mechanical and electrical connectivity between the body 30 and the cartomizer 20. The connector 25B typically includes two electrical contacts (not shown in FIG. 2) to act as positive and negative terminals for supplying power from the battery 330 to the heater 235 within cartomizer 20. The two electrical contacts may have any appropriate configuration—e.g. side by side, or an inner contact surrounded by a ring forming an outer contact, depending upon the particular design of the connector 25.

The body 30 further includes a button 340 and a user interface 380, which may be operated as discussed above. The battery unit 330 used in e-cigarette 10 most commonly includes a lithium ion cell. This type of battery produces an output voltage when fully charged of about 4.2V, declining to about 3.6V when discharged. Other embodiments however may utilize other battery types as appropriate. The battery unit 330 further includes an in-built power control system 450, which is linked to the controller 410. The controller 410 is able to turn the battery output to the connector 25B off and on using the power control system 450 (the controller itself may still be able to draw some power from the battery unit in order to provide control functionality).

For most of the time, the power control system 450 generally prevents output from the battery to the connector 25B. However, if a user activates the e-cigarette, e.g. by puffing on the e-cigarette for a puff-sensitive device, then the controller 410 may signal the power control system 450 to supply power from the battery unit 330 to the heater 235 for a predetermined period of time, after which predetermined period of time, the controller instructs the power control system 450 to turn off again the power supply from the battery unit to the cartomizer 20. Alternatively, the controller may provide power to the heater 235 for as long as the user is detecting as inhaling upon the device (typically subject to some maximum activation time).

The power control system 450 may also be able to regulate the amount of current supplied from the battery unit 330 to the cartomizer 20. One way of achieving this is to utilize pulse width modulation (PWM), in which the battery unit supplies power ("on") for a first predetermined period of time ($T_{on}$), and then does not supply power ("off") for a second predetermined period of time ($T_{off}$). This pattern is repeated, with an overall period of $T_{on}+T_{off}$, with a duty cycle (the proportion of time spent on) of $T_{on}/(T_{on}+T_{off})$. The duty cycle therefore falls within the range 0-1; as the duty cycle increases towards 1 (unity), the power output from the battery unit 330 approaches the maximum available from the battery unit 330. Note that the repetition period ($T_{on}+T_{off}$) is generally much less than the thermal response time of the heater. Accordingly, the heater temperature does not oscillate significantly with individual cycles of the PWM pattern, but rather reflects the overall duty cycle. In other words, the effective heating current supplied with a duty cycle of 0.5 is only half the effective heating current that is supplied with a duty cycle of 1.0 (which, in effect, represents a constant level of current without PWM). The effective heating current supplied with a duty cycle of 0.25 is then only half the effective heating current that is supplied with a duty cycle of 0.5, and so on. Thus the controller 410 can set the duty cycle utilized by the power control system 450 in order to manage (control) the power level supplied from the battery to the cartomizer—including turning off the power supplied to the cartomizer by setting a duty cycle of 0 (zero).

Figure 3:
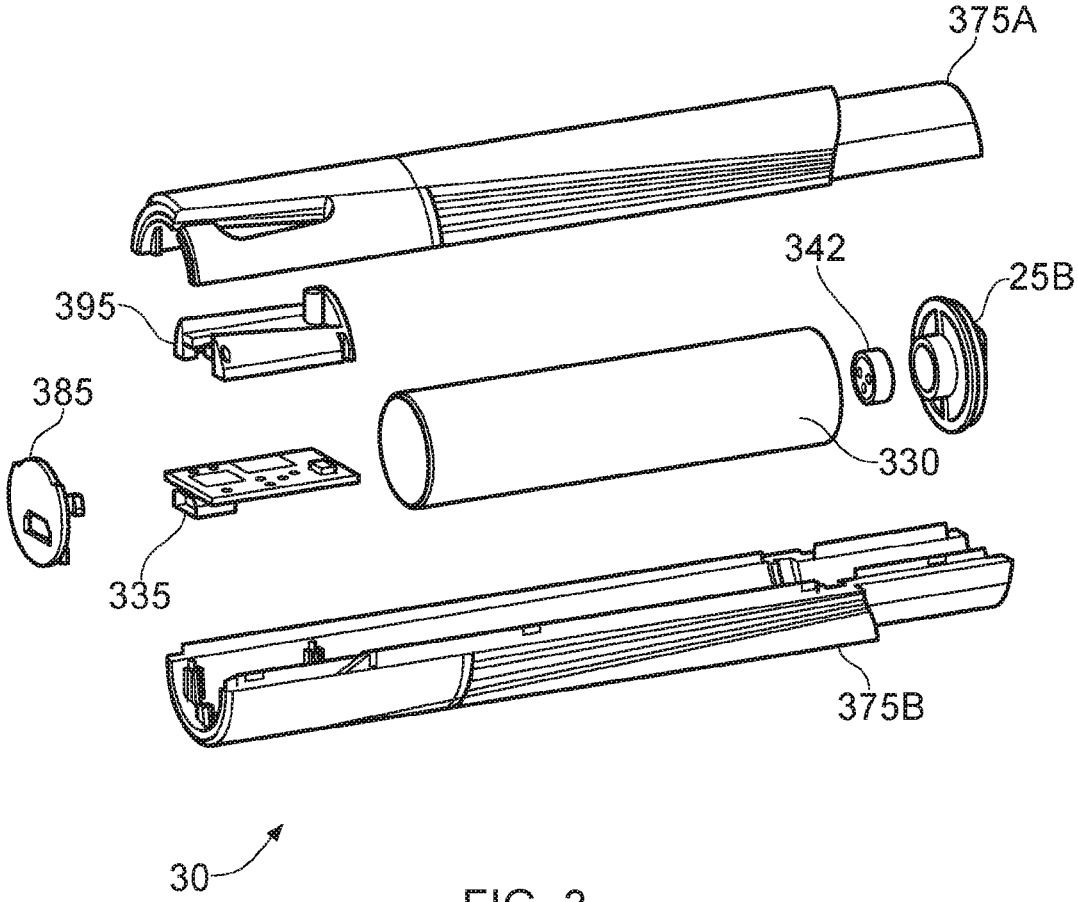
FIG. 3 is an exploded diagram of a body portion of an e-cigarette in accordance with some embodiments of the disclosure.

FIG. 3 is an exploded view of the device portion 30 of an e-cigarette 10 in accordance with some embodiments of the disclosure. The device portion includes an upper housing 375A and a lower housing 375B. (In this context, the terms upper and lower are somewhat arbitrary, but as described in more detail below, button 340 is implemented as part of the upper housing 375A, and hence it is most likely that this portion of the device would be held in an accessible position, e.g. facing upwards).

The connector 25B is located at one end of the device portion 30 to provide electrical and mechanical connectivity to a cartomizer (not shown), as described above. At the opposite end of the device portion 30 from connector 25B, sometimes referred to as the tip (or distal) end, since in use it is furthest from the mouth (and mouthpiece 35), is the end plug 385. The end plug 385 includes an opening for forming a micro-USB socket which can be used for re-charging battery 330, and also potentially for performing external data communications.

Internal to the body 30 are a battery 330 and a microphone 342, the latter being adjacent the connector 25B. The microphone 342 is used as a pressure sensor to detect a user puff or inhalation on the e-cigarette 10, which then serves as a trigger to activate the device to supply power from the battery 330 to the cartomizer as described above. Also internal to the body 30, adjacent the end plug 385, are a PCB 335 and a light emitting diode (LED) lens 395.

The PCB includes a controller 410 and a micro-USB socket (to align with the corresponding hole in the end plug 385). The PCB 335 further includes a button 340 and a light that provides a user interface 380. (N.B. because of their small size, these the individual components of the PCB 335 are not explicitly referenced in FIG. 3 and onwards). In some embodiments, the button 340 and the user interface 380 are provided as a combined unit on the PCB, but in other embodiments, they may be separate components. The button may be activated from the external surface (upper housing 375A) of the device portion, as described in more detail below. Light from the user interface 380 is conveyed from the PCB to the external surface (upper housing 375A) by LED lens 395.

Figure 4:
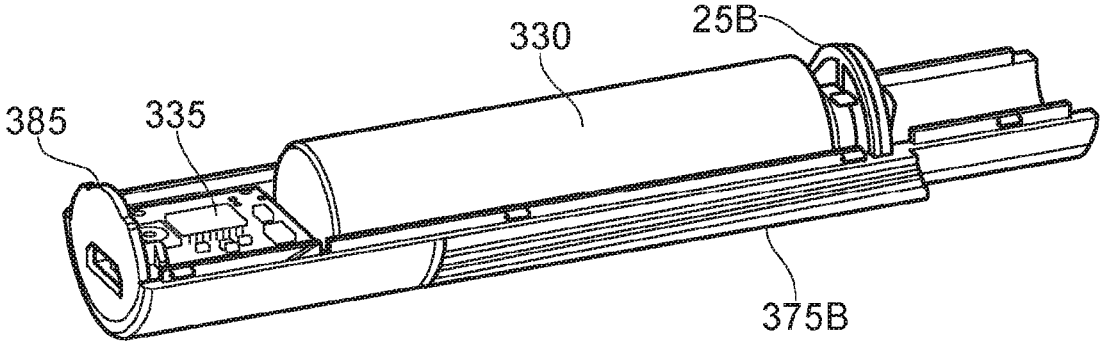
FIG. 4 shows the various components of the e-cigarette of FIG. 3 assembled into the lower housing in accordance with some embodiments of the disclosure.
Figure 5:
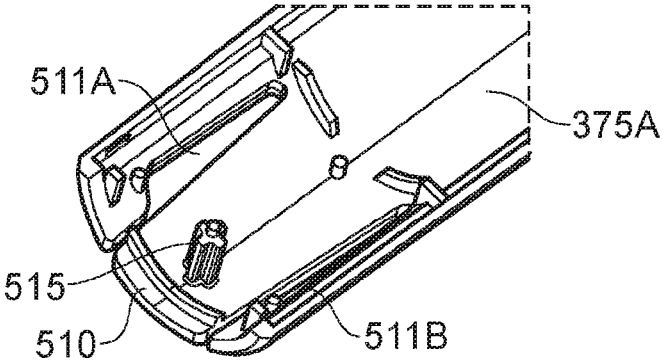
FIG. 5 shows a portion of the upper housing of the e-cigarette of FIG. 3 in accordance with some embodiments of the disclosure.

FIG. 4 shows the components of FIG. 3 assembled together, apart from the LED lens 395 and the upper housing 375A. FIG. 5 shows a view of the underside of the upper housing 375A, i.e. as seen from the interior of the device portion 30. The end portion of the upper housing 375A, i.e. the portion adjacent end plug 385, has two broadly parallel slots 511A, 511B extending from the end of the upper housing 375A in a longitudinal direction, i.e. towards the connector 25B. These slots, which are both approximately 10 mm in length, define a cantilever portion 510. Because the upper housing 375A is made of a resilient and slightly flexible material (plastic), this cantilever can be deflected slightly inwards (towards the interior of the device portion 30), but will return to its rest position when the deflecting force is removed. Note that in this rest (undeflected) position, i.e. generally when the button is not being operated by a user, the cantilever portion 510 is generally flush with the outer surface of upper housing 375A. Relatively near to the end of the cantilever portion (i.e. adjacent the end plug 385), the cantilever portion 510 is provided with an inwardly directed pillar 515 that extends into the interior of the device portion 30 (when the upper housing is assembled).

Figure 6:
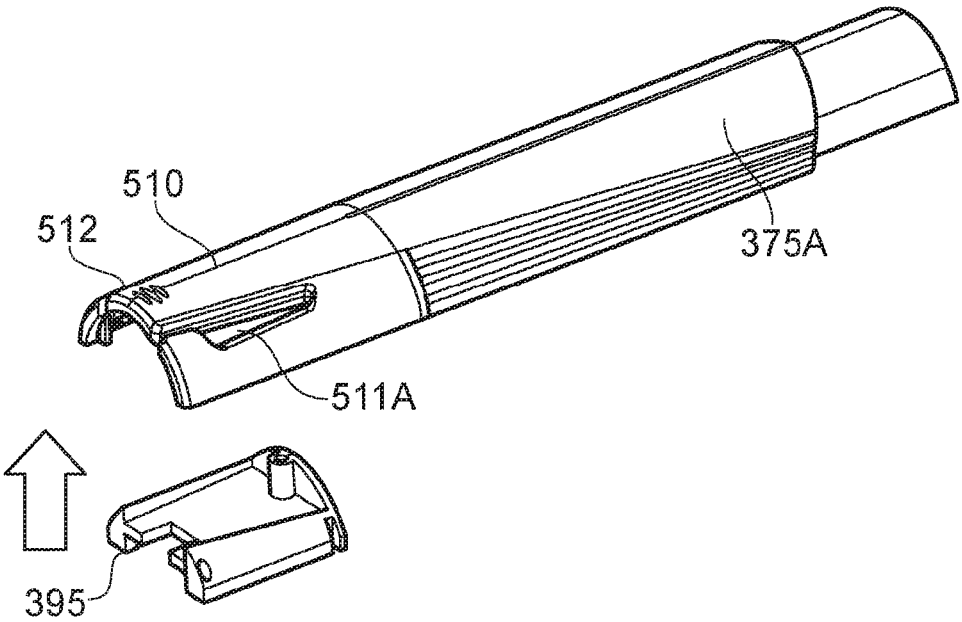
FIG. 6 shows an LED lens ready to be assembled to the upper housing of the e-cigarette of FIG. 3 in accordance with some embodiments of the disclosure.

FIG. 6 shows the upper housing 375A from above, and also the LED lens 395 in position for assembly with the upper housing 375A. Note that the upper (external) surface of the cantilever portion 510 is provided with some texturing, in this particular case, three transverse ribs 512. This texturing helps a user apply a force to the cantilever portion to deflect it inwards, as described above, without slipping.

Figure 7:
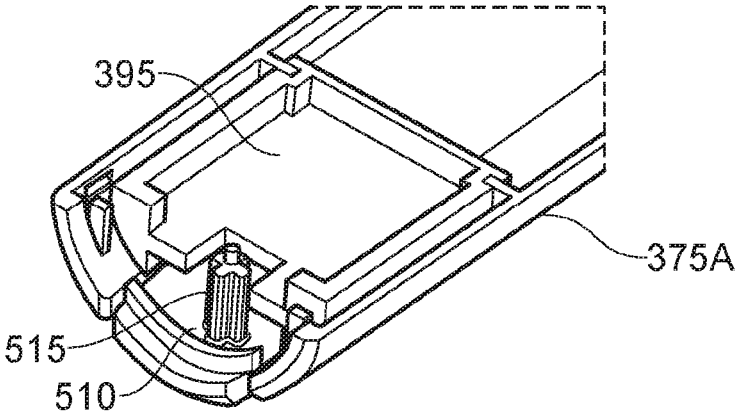
FIG. 7 shows the LED lens assembled to the upper housing of the e-cigarette of FIG. 3 in accordance with some embodiments of the disclosure.
Figure 8:
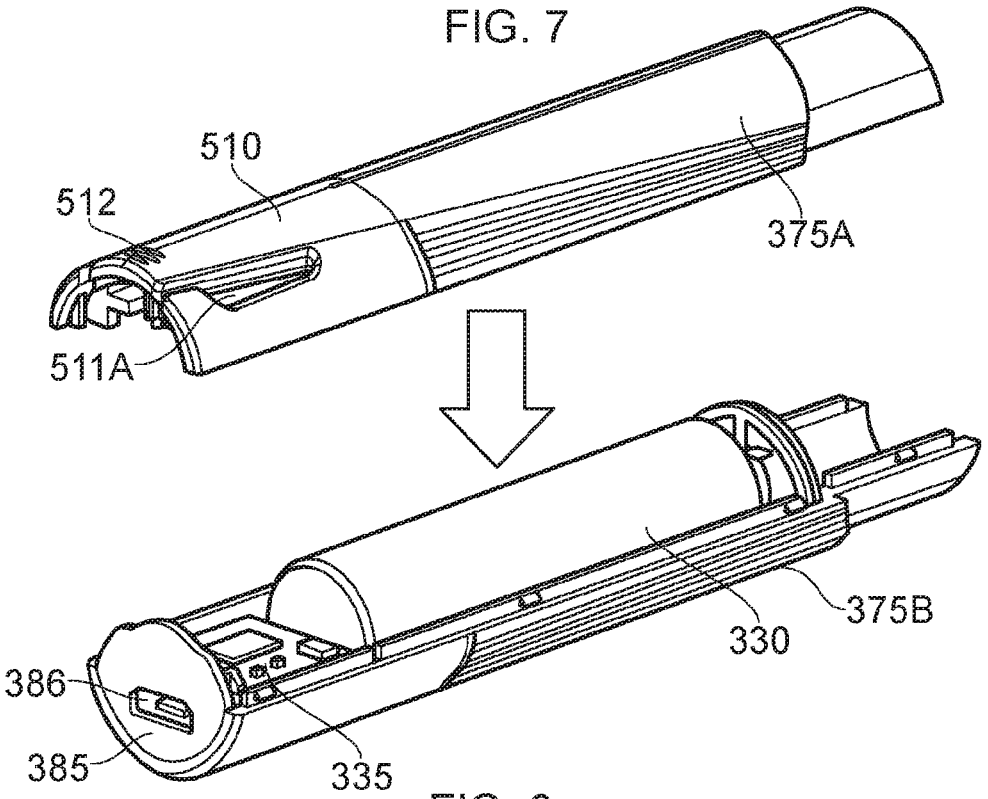
FIG. 8 shows the upper housing and LED lens ready to be assembled to the lower housing and components therein in accordance with some embodiments of the disclosure.

FIG. 7 shows a view of the underside of the upper housing 375A, i.e. as seen from the interior of the device portion 30, analogous to the view of FIG. 5, but with the LED lens 395 now assembled together with the upper housing 375A. Note that the pillar 515 provided on the underside of the cantilever portion 510 extends inwards past the LED lens 395. FIG. 8 then shows in schematic form the upper housing 375A and LED lens 395 being assembled with the lower portion of the body 30 (as shown in FIG. 4).

Figure 9:
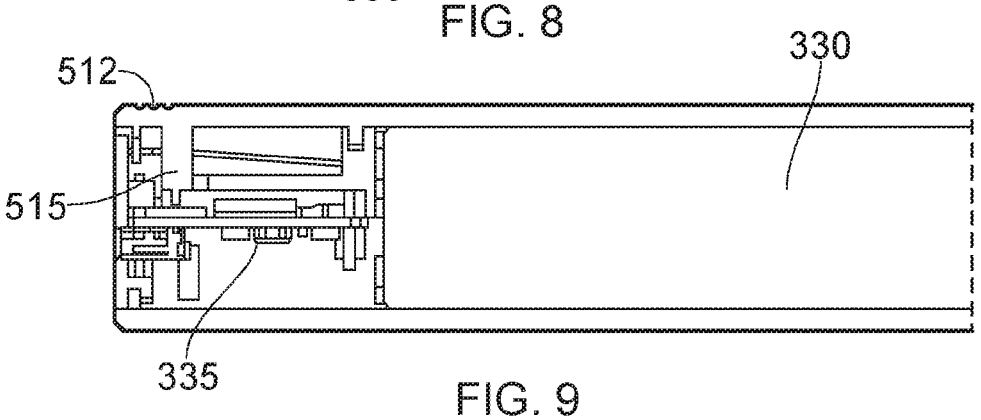
FIG. 9 is a vertical cross-section through the assembled e-cigarette of FIG. 3 in accordance with some embodiments of the disclosure.

FIG. 9 shows a longitudinal cross-section through the assembled device portion 30 (this cross-section would be in a vertical plane in accordance with the orientation of the upper and lower housings 375A, 375B). The texturing 512 on the top of the cantilever portion 510 is visible, as is the pillar 515 extending inwardly (downwards) from the inside of the cantilever portion. The pillar 515 engages the PCB 335. More particular, the PCB 335 includes a button 340 (not specifically indicated in FIG. 9). When the cantilever portion 510 is deflected inwards (downwards), the pillar 515 engages and operates button 340. Accordingly, the cantilever portion 510 allows a user to operate button 340 by pressing on the outer surface of the cantilever portion 510, which can be considered as part of the upper housing 375A.

FIG. 9 also shows the LED lens 395 (not specifically indicated in FIG. 9) located between the PCB 335 and the cantilever portion 510. The PCB 335 includes a user interface 380, namely a light emitting diode (LED), which can be used to provide a light signal to the user. The LED lens 395 acts to distribute the light from this LED to make it more visible to a user—in particular, the LED lens 395 allows light from the LED to be seen through the slots 511A, 511B on either side of the cantilever portion.

Figure 10A:
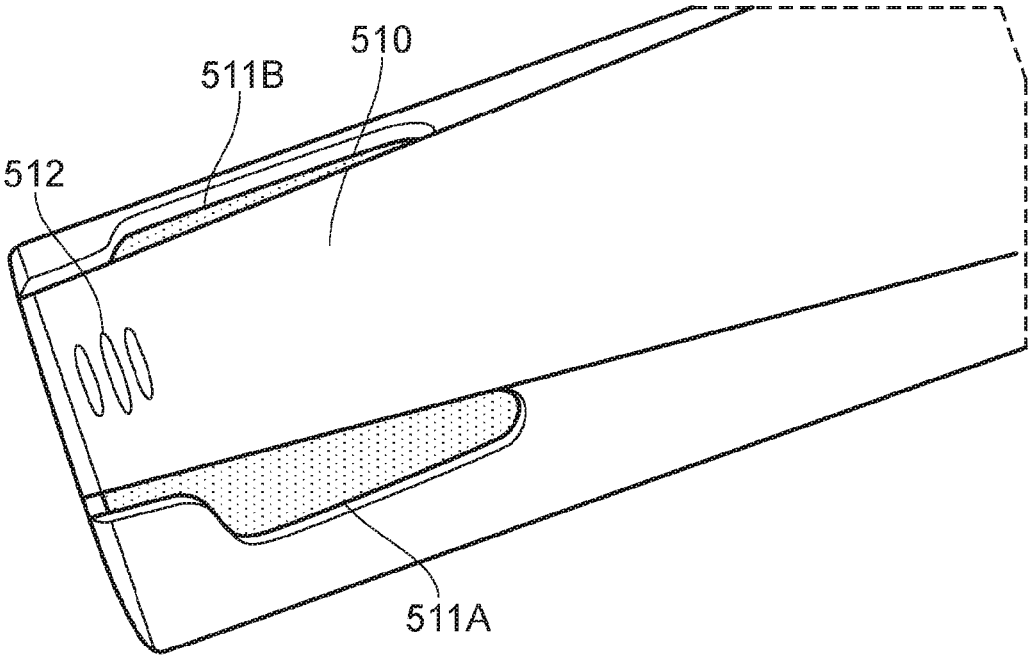
FIGS. 10A and 10B are detailed views of the assembled e-cigarette of FIG. 9 from the top (FIG. 10A) and from the side (FIG. 10B).
Figure 10B:
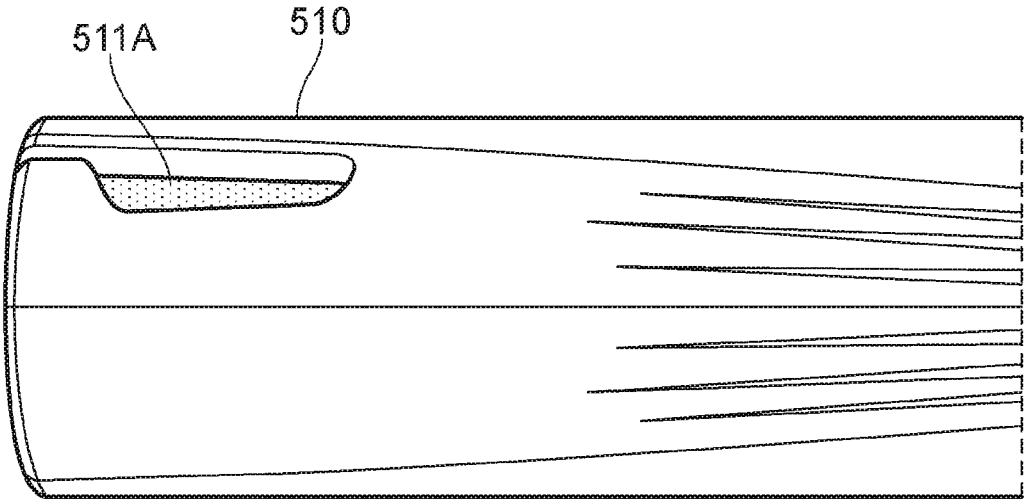

This is seen more clearly in FIGS. 10A and 10B, which show the cantilever portion 510 from the top (FIG. 10A) and from the side (FIG. 10B). It can be seen that the cantilever portion 510 includes surface texturing 512 to help a user grip and hence deflect the cantilever portion 510 inwards in order to operate button 340. In addition, the light produced by the LED on PCB 335 (and routed through LED lens 395) is visible in the slots 511A, 511B on either side of the cantilever portion.

Overall, the device portion shown in FIGS. 3 through 10A and 10B can be considered to provide a cantilever button, which is robust and reliable while also being relatively cheap to implement. In addition, the cantilever button allows for a relatively uncluttered design, and the gaps or slots 511A, 511B around the cantilever section can be used, if so desired, for illumination, e.g. for providing light signals to a user as part of the user interface.

An electronic vapor provision device as described herein may comprise a complete e-cigarette (or similar system), such as the combination of cartomizer 20 and body portion 30 shown in FIG. 1 (in exploded form), or may comprise a device (or body), such as shown in FIGS. 3 and 8 (in exploded form) to which a cartridge or cartomizer can be fitted as appropriate for use. Although the electronic vapor provision device 10 shown in FIG. 1 utilizes an electric coil heater 235 to vaporize liquid from reservoir 210, other implementations may utilize different forms of vapor (aerosol) precursor, such as solids, pastes or gels (or hybrid approaches) and/or utilize other forms of vapor/aerosol generation from the precursor, such as induction heating, or non-heating methods—e.g. piezo atomization, and so on.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other inventions not presently claimed, but which may be claimed in future.

The invention claimed is:

1. An electronic vapor provision device comprising:

an external housing including two slots that each terminate at an end of the external housing, wherein the two slots define a cantilever; and a button, wherein the cantilever is configured to operate the button.

2. The electronic vapor provision device of claim 1, wherein the cantilever is integrally formed in the external housing of the electronic vapor provision device.

3. The electronic vapor provision device of claim 1, wherein when the button is not being operated by the cantilever, the cantilever is flush with the external housing of the electronic vapor provision device.

4. The electronic vapor provision device of claim 1, wherein the cantilever is formed in a distal end of the electronic vapor provision device.

5. The electronic vapor provision device of claim 1, wherein the electronic vapor provision device includes a disposable portion which includes a source of aerosol precursor material, and a re-usable portion which does not contain a source of aerosol precursor material, and the cantilever is formed in the re-usable portion of the electronic vapor provision device.

6. The electronic vapor provision device of claim 1, wherein the electronic vapor provision device comprises a re-usable portion configured for attachment to a disposable portion which includes a source of aerosol precursor material.

7. The electronic vapor provision device of claim 1, wherein the cantilever is textured on an outer surface.

8. The electronic vapor provision device of claim 1, wherein the cantilever includes an inwardly directed pillar which is used to engage and operate the button when the cantilever is deflected inwards.

9. The electronic vapor provision device of claim 1, wherein the cantilever is formed of a resilient plastic.

10. The electronic vapor provision device of claim 1, wherein the cantilever is configured to have a rest position, and may be resiliently deflected by a force from the rest position to operate the button, and wherein the cantilever is configured to return to the rest position when the force is removed.

11. The electronic vapor provision device of claim 10, wherein the cantilever is deflected inwardly with respect to the electronic vapor provision device to operate the button, wherein the button is located inside the electronic vapor provision device.

12. The electronic vapor provision device of claim 1, wherein the cantilever has a length in a range of 5 mm to 25 mm.

13. The electronic vapor provision device of claim 12, wherein the cantilever has a length in a range of 8 mm to 15 mm.

14. The electronic vapor provision device of claim 1, further comprising a light provided in association with the cantilever-operated button.

15. The electronic vapor provision device of claim 14, further comprising a pair of slots, one slot being located on each side of the cantilever, wherein illumination from the light is visible through the pair of slots.

16. The electronic vapor provision device of claim 15, further comprising a lens to direct the illumination from the light through the pair of slots.

* * * * *